United States Patent [19]

Hamasaki

[11] 3,987,995

[45] Oct. 26, 1976

[54] DISPLAY DEVICE

[76] Inventor: Leslie T. Hamasaki, 4958 Coringa Drive, Los Angeles, Calif. 90042

[22] Filed: July 15, 1974

[21] Appl. No.: 488,750

[52] U.S. Cl. ..... 248/450; 248/459; 229/8

[51] Int. Cl.[2] ..... A47B 97/04

[58] Field of Search ..... 248/450, 459, 466, 174; 40/155, 124.1, 126 A; 229/8; 206/45.31, 45.14, 491

[56] References Cited

UNITED STATES PATENTS

| | | | |
|---|---|---|---|
| 1,499,891 | 7/1924 | Storer | 40/124.1 |
| 2,844,473 | 7/1958 | Seiferth et al. | 229/8 |
| 3,021,042 | 2/1962 | Stumpf | 248/174 |
| 3,084,843 | 4/1963 | Urban | 229/8 |
| 3,337,033 | 8/1967 | Cote | 206/45.14 |
| 3,682,298 | 8/1972 | Guillerm | 206/45.31 |
| 3,713,576 | 1/1973 | Goebel | 229/8 |
| 3,815,735 | 6/1974 | Cucuo | 229/8 |

FOREIGN PATENTS OR APPLICATIONS

| | | | |
|---|---|---|---|
| 262,141 | 5/1968 | Austria | 229/8 |
| 442,133 | 1/1968 | Switzerland | 229/8 |

*Primary Examiner*—Robert A. Hafer
*Attorney, Agent, or Firm*—Donald D. Mon

[57] ABSTRACT

A display device formable from a scored sheet of stiffly flexible material for holding an article. The display device is a flattened tube forming an internal cavity and having an aperture through its wall to give visual access to an article therein. A knee is formed by forming a portion of the wall inwardly so as at least partially to occlude the cavity inside the tube and support the article.

6 Claims, 8 Drawing Figures

DISPLAY DEVICE

This invention relates to a display device useful for holding articles such as photographs, terrariums, and in general any object which has a dimension of length, width and thickness. It is expected to find its principal application in the field of photographs where it provides readily-folded, free-standing, and attractive display means.

Picture frames and the like are generally known, as are various folded structures for holding photographs and other similar objects, but if they are self-supporting, they are usually bulky, and if they are not bulky, they are complicated or not self-supporting. It is an object of this invention to provide a display device which can hold such articles in a freely-standing condition, which can be made out of light-weight inexpensive material, such as a cellulose material in the form of light cardstock or cardboard, and which can be readily folded and unfolded by the user. It may be shipped flat as raw blanks to be folded, or it can be shipped flat in its folded state ready to use after making a simple fold to form a knee to support the article, and to make the device free-standing.

A display device according to this invention comprises a tube having a wall with an inside surface and an outside surface, the inside surface forming an internal cavity possessing a dimension of axial length and a transverse dimension of width. The tube is made of a material which is stiffly flexible and is preferably (but not necessarily) flattened out of round. The tube has a free edge which may be its end or a slit through its side. A knee is formed in the wall by the folding inwardly of the wall adjacent to the free edge along an edge segment and along two boundary fold edges that depart from the segment so as to form an angle opening toward the free edge. The edges and segment form a set which terminates at the free edge. The segment moves angularly into the cavity when the wall is folded along the fold edges. The segment lies parallel to the dimension of axial length prior to the said folding. An aperture is formed through the wall to give visual access to an article restrained in the cavity by the knee.

According to a preferred but optional feature of the invention, a pair of said knees is formed at opposite sides of the tube, whereby to give support to the article at two opposite sides thereof and to hold the tube somewhat open so as to form a substantial base so it will remain free-standing.

According to still other optional features of the invention, a plurality of these structures may be formed in line in a unitary device.

The above and other features of this invention will be fully understood from the following detailed description and the accompanying drawings in which.

Figure 3:
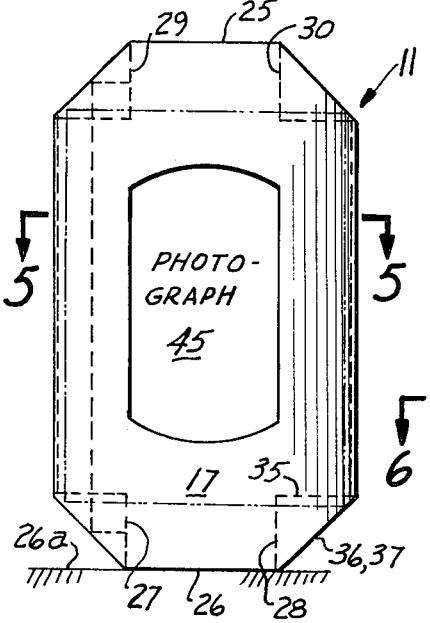
FIG. 3 shows the structure of FIG. 2 assembled to hold a photograph.
Figure 4:
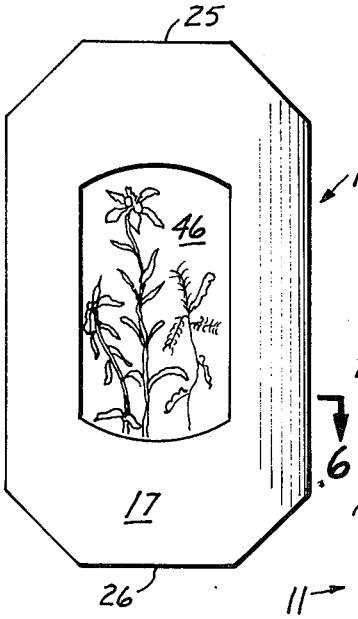
FIG. 4 shows the device supporting a terrarium.
Figure 5:
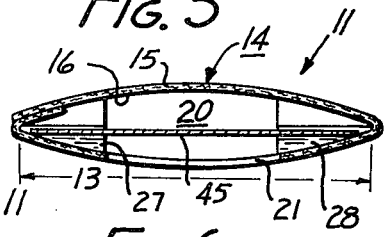
Figure 6:
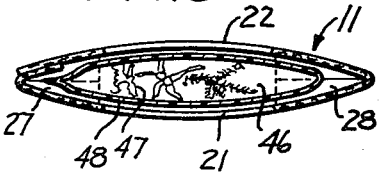
Figure 7:
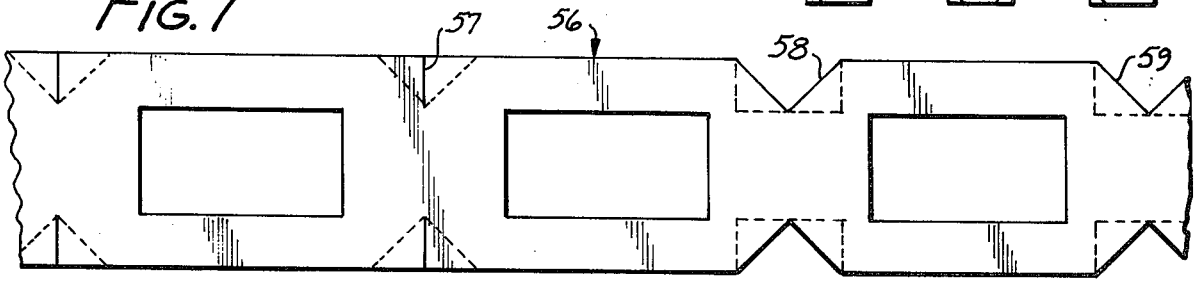

FIGS. 5 and 6 are cross-sections taken at lines 5—5 and 6—6, respectively, of FIGS. 3 and 4;

FIG. 7 is a side view of another embodiment of the invention; and

Figure 8:
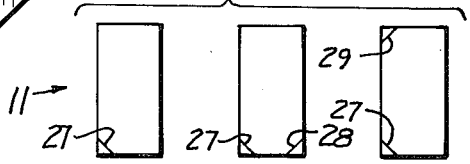

FIG. 8 schematically illustrates three other possible knee arrangements.

Figure 1:
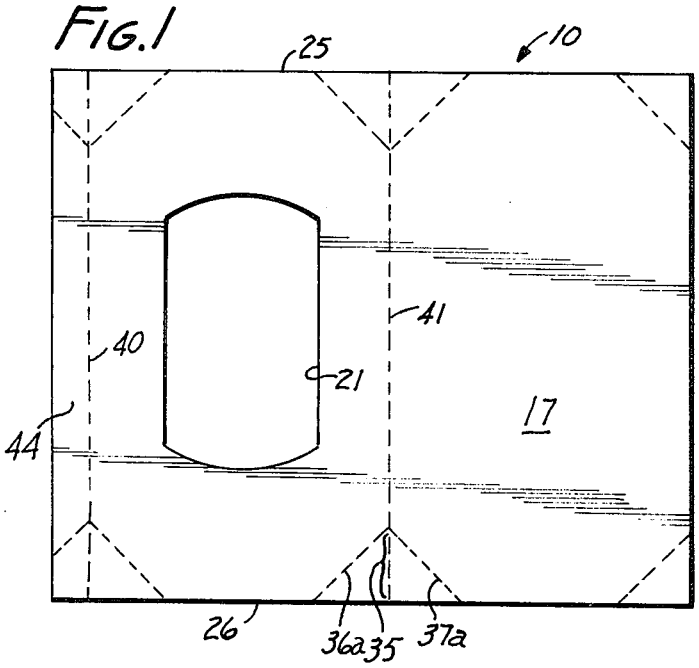
FIG. 1 is a plan view of a blank for making the presently preferred embodiment of the invention.
Figure 2:
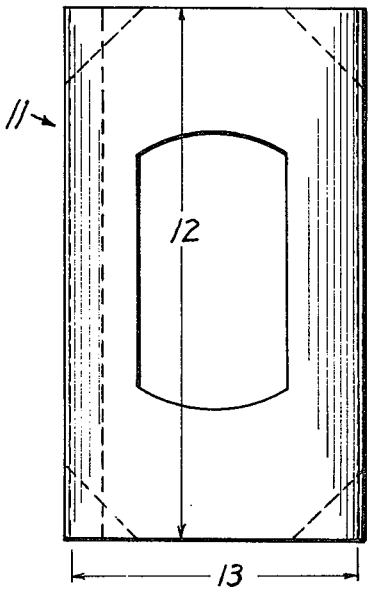
FIG. 2 shows the blank of FIG. 1 formed to an intermediate condition.

FIG. 1 shows a blank 10 for making the display device 11 shown in FIG. 3. As best shown in FIGS. 2 and 3, the display device has a dimension of axial length 12 an a transverse dimension of width 13. The display is formed as a tube 14 with a wall 15 (FIG. 5) having an inside surface 16 and an outside surface 17. The inside surface forms an internal cavity 20.

The material of the wall is stiffly flexible and is preferably cellulose material, for example, paper cardstock, which can readily be folded and which will maintain its fold, but which is stiffly flexible so as to tend to maintain a bent shape except where it is sharply folded.

The tube is shown in a condition frequently described as "flattened out of round", meaning a semi-flattened arrangement which is flatter than the circular configuration it would otherwise have. "Flattened out of round" does not necessarily mean surface-to-surface contiguity of the two sides of the display device, but includes the shapes shown in FIGS. 5 and 6.

An aperture 21 is formed through the wall. In some embodiments (FIG. 6), a second aperture 22 may be provided to give visual access to both sides of an article in the device.

The tube has a pair of free edges 25, 26 which constitute the ends of the display device, and either may be used as the base when it is free-standing on a table 26 a or other support. At least one knee 27 is formed by folds yet to be described. Preferably, the knees are formed in sets of pairs, such as knees 27, 28 and knees 29 and 30. However, as best shown in FIG. 8, only one knee 27 need be provided, or only knees 27 and 28 may be formed, both at the bottom, or only knees 27 and 29 need be formed, one at each end. These drawings illustrate the wide range of knee arrangements which can be utilized.

Whatever number is utilized, each knee is formed identically, and therefore only knee 28 will be described in detail. This knee includes a segment 35 of a side fold edge 41*a* and pair of boundary fold edges 36, 37. The boundary fold edges terminate and intersect at the segment 35, and these boundary fold edges and the segment terminate at free edge 26 and together form a "set". The boundary fold edges form an angle which opens toward this free edge.

It will be seen in FIG. 3 that the knee is formed by oppositely folding the central fold edge and the boundary fold edges so that the central fold edge moves inwardly into the cavity so as at least partially to occlude the cavity and prevent the photograph or other article from falling out.

The means readily to form these fold edges is a plurality of scores formed where the folds are to be made. The term "score" is well known in the art of manufacturing paper articles and comprises permanently indenting the cellulosic material at the place the fold is to be formed so that a fold will readily be formed along the score, and not adjacent to it. In this way, folds can readily and accurately be formed.

The blank 10 is formed in this manner and includes a pair of laterally spaced-apart scores 40, 41 to form a pair of side fold edges 40*a*, 41*a*. These include the respective segment of the respective knees. The scores 36*a* and 37*a* are shown departing from score 41, segment 35 being included in score 41. The other scores indicated by dashed lines are similarly formed. The tubular structure can be formed by folding the article at scores 40 and 41. The small tab 44, located between the left-hand edge of the article in FIG. 1 and score 40, may be provided with glue or other adhesive, and may thereby be attached to the right-hand area of FIG. 1. It may instead be stapled or otherwise attached. The construction can be totally flat in this configuration and can be shipped in tightly compressed stacks. When the knees are formed, the knees will tend to open the cavity and spread the inside surfaces apart to form the cavity. This spreads the free edges to provide support means whereby the device becomes free-standing and self-supporting.

When the knee or knees is folded in, an article 45, such as the photograph in FIGS. 3 and 5, or an article 46, such as a terrarium in FIGS. 4 and 6, may be placed into the cavity, and if knees are provided at opposite ends, those folds will thereafter form to hold the article in the cavity. The terrarium shown comprises plant material 47 inside a cellophane or plastic bag 48. Dried plant material, or even living plant material, may be used therein. The photograph and terrarium are examples of articles having dimensions of length, width and thickness suitable for this type of display.

FIG. 7 shows another display device 56 which comprises a continuous strip of articles such as that of FIG. 1. In this case, at least one set of free edges 57 is formed in the form of a slit through the wall. This happens also to be true where knees 58 and 59 are formed. In the other embodiments where only a single article is to be held, then the free edges may conveniently comprise the end of the display device. However, it is possible in any device for the free edge to comprise a slit spaced from the end of the display device. Such an arrangement provides a greater length of tube edge to support the device. The articles are joined at their side edges, i.e. despite the slits 57 which cut the side edges, the structure is integral from side edge to side edge.

The display devices according to the invention are inexpensive, readily manufactured, and easy to use structures which can be made free-standing, which provide ample surface are (surface 17, for example) to carry advertisements, messages, or decorations, and which are useful to support a wide range of articles from quick Polaroid pictures to articles intended for more permanent display.

This invention is not to be limited by the embodiments shown in the drawings and described in the description, which are given by way of example and not of limitation, but only in accordance with the scope of the appended claims.

I claim:

1. A display device for holding an article, the article having dimensions of length, width, and thickness, said device comprising a flattened tube having a longitudinal axis, a wall with an inside surface and an outside surface, the inside surface forming an internal cavity having dimensions of axial length and of transverse width, said tube being made of a material which is stiffly flexible, and which has a pair of end edges and a pair of opposed side fold edges diametrically spaced apart from one another and extending from end edge to end edge, a pair of boundary fold edges which depart from one of said side fold edges so as to form an angle opening toward the respective end edge, and including a segment of one of said side fold edges, said boundary fold edges and segment forming a set which terminates at said end edge, the said segment moving angularly into said cavity when the wall is folded along said boundary fold edges, whereby the said folding forms a knee which at least partially occludes the cavity to form a restraint for supporting the article in the cavity, the wall having an aperture therethrough to give visual access to said article when resting upon the knee.

2. A display device according to claim 1 in which one of said sets is provided at each of the side fold edges adjacent to one of said end edges.

3. A display device according to claim 1 in which one of said sets is provided at both ends of both of said side fold edges.

4. A display device according to claim 1 in which a pair of said devices are connected at their side edges.

5. A display device according to claim 2 in which a fold score is formed in the wall of the tube at all of the said side fold and boundary fold edges to facilitate making the folds.

6. A display device according to claim 3 in which a fold score is formed in the wall of the tube at all of the said side fold and boundary fold edges to facilitate making the folds.

* * * * *